US006524521B1

(12) United States Patent
Kuroiwa et al.

(10) Patent No.: US 6,524,521 B1
(45) Date of Patent: Feb. 25, 2003

(54) METHOD OF AND APPARATUS FOR MANUFACTURING LONGITUDINALLY ALIGNED NONWOVEN FABRIC

(75) Inventors: Yuki Kuroiwa, Saitama (JP); Kazuhiko Kurihara, Tokyo (JP); Kazuhiro Yabe, Tokyo (JP); Akira Nii, Chiba (JP); Shin-ichi Umejima, Chiba (JP)

(73) Assignees: Nippon Petrochemicals Co., Ltd., Tokyo (JP); Polymer Processing Research Institute Ltd., Tokyo (JP)

( * ) Notice: Subject to any disclaimer, the term of this patent is extended or adjusted under 35 U.S.C. 154(b) by 238 days.

(21) Appl. No.: 09/645,181

(22) Filed: Aug. 24, 2000

(30) Foreign Application Priority Data

Aug. 30, 1999 (JP) ..... 11-243031

(51) Int. Cl.[7] ..... D01D 5/088; D01D 5/098; D04H 3/02

(52) U.S. Cl. ..... 264/555; 26/71; 264/103; 264/210.7; 264/210.8; 264/211.14; 264/237; 264/288.4; 425/72.2; 425/363; 425/378.2; 425/383.2; 425/464

(58) Field of Search ..... 264/103, 210.7, 264/210.8, 211.14, 237, 288.4, 555; 425/72.2, 363, 378.2, 382.2, 464; 26/71

(56) References Cited

U.S. PATENT DOCUMENTS 5,045,271 A * 9/1991 Mente et al. ..... 264/555
5,312,500 A 5/1994 Kurihara et al.
5,807,795 A 9/1998 Lau et al.

FOREIGN PATENT DOCUMENTS

DE 24 08 080 A1 8/1975
FR 2 217 459 A 9/1974

* cited by examiner

*Primary Examiner*—Leo B. Tentoni
(74) *Attorney, Agent, or Firm*—Knobbe Martens Olson & Bear LLP

(57) ABSTRACT

An apparatus for manufacturing a nonwoven fabric has a spinning mechanism having a plurality of nozzles for extruding filaments, and a conveyor for collecting and delivering the extruded filaments. Between the spinning mechanism and the conveyor, there are disposed a high-speed air stream generating mechanism for generating a high-speed air stream to carry the filaments extruded from the nozzles to attenuate the filaments, and an air stream vibrating mechanism for periodically changing the direction of the high-speed air stream in the machine direction of the conveyor.

22 Claims, 6 Drawing Sheets

METHOD OF AND APPARATUS FOR MANUFACTURING LONGITUDINALLY ALIGNED NONWOVEN FABRIC

BACKGROUND OF THE INVENTION

1. Field of the Invention

The present invention relates to a nonwoven fabric of longitudinally aligned filaments, a nonwoven fabric produced by longitudinally stretching such a nonwoven fabric of longitudinally aligned filaments, and a method of and an apparatus for manufacturing such nonwoven fabrics.

Nonwoven fabrics according to the present invention are excellent in mechanical strength and dimensional stability, and can be used as a material web for nonwoven fabrics that are strong in one direction and perpendicularly crossed nonwoven fabrics.

2. Description of the Related Art

Known processes for manufacturing nonwoven fabrics include a spunbond process, a melt-blow process, and a spunlace process for processing spun yarns directly into nonwoven fabrics. Nonwoven fabrics manufactured by these processes are referred to as spunbonded nonwoven fabrics in a wide sense. The nonwoven fabrics manufactured by these processes are the mainstream of nonwoven fabrics as they are economical and mass-producible.

The spunbonded nonwoven fabrics in a wide sense are randomly nonwoven fabrics in which filaments are randomly aligned. Many of those spunbonded nonwoven fabrics are of small mechanical strength and have no dimensional stability. The inventors of the present invention have devised a process of stretching a nonwoven fabric and a process of manufacturing a nonwoven fabric which comprise laminated perpendicularly crossed nonwoven fabrics in order to eliminate the drawbacks of conventional nonwoven fabrics (see Japanese patent publication No. 36948/92 and Japanese laid-open patent publication No. 204767/98 for details).

Japanese patent publication No. 25541/84 discloses a process of aligning filaments in one direction by inclining a conveyor to the direction in which the filaments are ejected. Japanese laid-open patent publication No. 3604/95 reveals a process of depositing filaments ejected with an air stream on an air-permeable conveyor and controlling the air stream with an air stream blocking device disposed behind the conveyor for thereby spreading the filaments in the longitudinal direction to improve alignability of the filaments.

However, the above conventional processes fail to sufficiently align filaments to a high degree. Particularly, according to the process disclosed in Japanese laid-open patent publication No. 3604/95, since the air flows along the gradient of the conveyor and the ejected air is not drawn and removed at a most important spot where the filaments are placed on the conveyor, the filaments tend to flow on the conveyor due to the ejected air that has reached the conveyor, and the filaments are liable to be disarranged. Stated otherwise, it is necessary to prevent the filaments from being disarranged on the conveyor in order to manufacture a longitudinally aligned nonwoven fabric of highly aligned filaments.

Generally, in order to produce a nonwoven fabric of filaments that are sufficiently aligned longitudinally, it is not sufficient to align the filaments longitudinally in the spinning process. The best way of improving the alignment of filaments is to stretch the nonwoven fabric in the longitudinal direction. However, after the spinning process, the nonwoven fabric cannot well be stretched longitudinally because the filaments are not well aligned longitudinally and are not sufficiently cooled, and it is difficult to stretch the nonwoven fabric to high mechanical strength at a high magnification.

SUMMARY OF THE INVENTION

It is an object of the present invention to provide a method of and an apparatus for manufacturing a longitudinally aligned nonwoven fabric that filaments are highly aligned longitudinally.

Another object of the present invention is to provide a method of and an apparatus for manufacturing a longitudinally stretched nonwoven fabric by further stretching a longitudinally aligned nonwoven fabric longitudinally for increased mechanical strength.

To achieve the above objects, a method of manufacturing a longitudinally aligned nonwoven fabric according to the present invention comprises the steps of preparing a group of nozzles for extruding a plurality of filaments, and a conveyor for collecting and delivering the filaments extruded from the group of nozzles, carrying the filaments extruded from the group of nozzles with a high-speed air stream to attenuate the filaments, and periodically changing the direction of the high-speed air stream in the machine direction of the conveyor.

An apparatus for manufacturing a longitudinally aligned nonwoven fabric according to the present invention comprises a spinning mechanism for extruding a plurality of filaments from nozzles, a high-speed air stream generating mechanism for generating a high-speed air stream to carry the filaments extruded from the nozzles to attenuate the filaments, a conveyor for collecting and delivering the filaments attenuated by the high-speed air stream, and at least one air stream vibrating mechanism for periodically changing the direction of the high-speed air stream in the machine direction of the conveyor.

The filaments extruded from the nozzles are attenuated by the high-speed air stream and collected on the conveyor. Since the direction of the high-speed air stream is periodically changed in the machine direction of the conveyor, i.e., in the longitudinal direction, the filaments carried by the high-speed air stream are periodically vibrated in the longitudinal direction, and partially folded over themselves in the longitudinal direction as they are collected on the conveyor. As a consequence, a nonwoven fabric in which filaments are well aligned is produced.

According to the present invention, for spinning the nonwoven fabric, a spunbond process in a wide sense is employed because the spunbond process is the most refined spinning process and excellent both economically and for its mass-producibility. The spunbond process in the wide sense resides in that molten filaments, i.e., filaments molten with heat, rather than being dissolved in a solvent, are drafted at a high magnification and attenuated by a high-speed air stream whose speed is close to the sonic speed.

As a result of studies made by the inventors, it has been found that the alignment of the filaments can be improved by periodically changing the direction of the high-speed air stream used to attenuate the filaments in the machine direction of the conveyor, and that the direction of the high-speed air stream can easily be changed based on the Coanda effect. According to a preferred embodiment, an air stream vibrating mechanism is disposed in a region where the high-speed air stream flows, the air stream vibrating mechanism having a wall surface, at least one of the direction of the wall surface with respect to the direction of the high-speed air stream and the distance of the wall surface from the direction of the high-speed air stream being variable, or alternatively, an air stream vibrating mechanism is disposed which has a wall surface inclined to the direction of the high-speed air stream, the distance between the wall surface and the air stream axis of the high-speed air stream being variable.

By cooling, with a mist, the high-speed air stream which has been supplied at a temperature equal to or higher than the melting point of the material of the filaments, the filaments carried and attenuated by the high-speed air stream can be cooled before their molecules are aligned in the longitudinal direction. As a result, when the nonwoven fabric is subsequently stretched in the longitudinal direction, the nonwoven fabric can be stretched to an increased extent.

According to the present invention, there are also provided a method of and an apparatus for manufacturing a longitudinally stretched nonwoven fabric.

The method of manufacturing a longitudinally stretched nonwoven fabric comprises the steps of manufacturing a longitudinally aligned nonwoven fabric by the above method of manufacturing a longitudinally aligned nonwoven fabric, and longitudinally stretching the longitudinally aligned nonwoven fabric.

The apparatus for manufacturing a longitudinally stretched nonwoven fabric comprises the above apparatus for manufacturing a longitudinally aligned nonwoven fabric, and a device for longitudinally stretching the longitudinally aligned nonwoven fabric manufactured by the apparatus for manufacturing a longitudinally aligned nonwoven fabric.

With the method of and the apparatus for manufacturing a longitudinally stretched nonwoven fabric, since the nonwoven fabric of filaments that have been highly aligned in the longitudinal direction is further stretched in the longitudinal direction, a nonwoven fabric that is excellent in mechanical strength in the longitudinal direction can be produced.

In the explanation of the direction in which the filaments are aligned and stretched, the term "longitudinal direction" means the machine direction in which the nonwoven fabric is manufactured, i.e., the direction in which the nonwoven fabric is fed, and the term "transverse direction" means the direction perpendicular to the longitudinal direction, i.e., the direction transversely across the nonwoven fabric.

The above and other objects, features, and advantages of the present invention will become apparent from the following description with reference to the accompanying drawings, which illustrate examples of the present invention.

DESCRIPTION OF THE PREFERRED EMBODIMENTS

Figure 1:
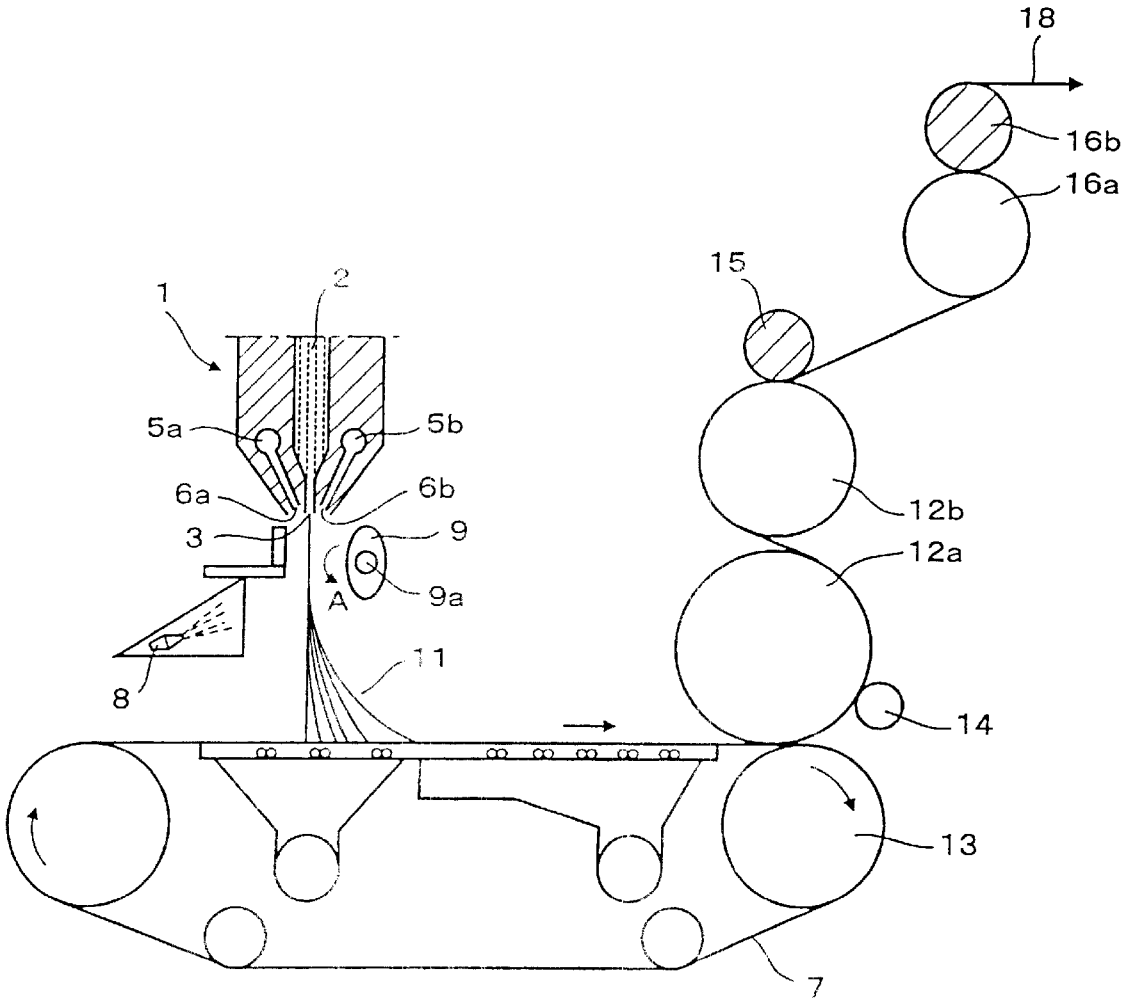
FIG. 1 is a schematic elevational view of an apparatus for manufacturing a nonwoven fabric in a melt-blow process according to the present invention.

Referring to FIG. 1, there is shown a apparatus for manufacturing a nonwoven fabric according to an embodiment of the present invention having a spinning unit mainly comprising a melt-blow die 1 and a conveyor 7, and a stretching unit comprising a pair of stretching rollers 12*a*, 12*b* and pair of withdrawal nip rollers 16*a*, 16*b*.

The melt-blow die 1 has a plurality of nozzles 3 in its lower distal end which are arrayed in a direction perpendicular to the sheet of FIG. 1. A molten resin 2 delivered from a gear pump (not shown) is extruded from the nozzles 3 to form a plurality of filaments 11. In FIG. 1, the melt-blow die 1 is shown in cross section for a better understanding of its internal structure, and only one of the nozzles 3 is illustrated. The melt-blow die 1 has a pair of air reservoirs 5*a*, 5*b* disposed one on each side of the nozzles 3. Air heated to a temperature equal to or higher than the melting point of the resin is introduced under pressure into the air reservoirs 5*a*, 5*b*, from which the air is ejected from slits 6*a*, 6*b* that communicate with the air reservoirs 5*a*, 5*b* and are open at the distal end of the melt-blow die 1. The ejected airflow as a high-speed air stream substantially parallel to the filaments 11 that are extruded from the nozzles 3. The high-speed air stream keeps the filaments 11 that are extruded from the nozzles 3 in a draftable molten state. The high-speed air stream applies frictional forces to the filaments 11 to draft the filaments 11 for thereby attenuating the filaments 11. The above mechanism is the same as the mechanism employed in the normal melt-blow process. The high-speed air stream has a temperature that is higher than the spinning temperature of the filaments 11 by 80° C. or more, or preferably 120° C. or more.

In the process of forming the filaments 11 with the melt-blow die 1, since the temperature of the filaments 11 immediately after they are extruded can be made sufficiently higher than the melting point of the filaments 11 by increasing the temperature of the high-speed air stream, the molecular orientation of the filaments 11 can be reduced.

The conveyor 7 is disposed downwardly of the melt-blow die 1. The conveyor 7 is trained around a conveyor rollers 13 that is rotatable by an actuator (not shown) and other rollers. When the conveyor rollers 13 is rotated about its own axis, the conveyor 7 is driven to deliver the filaments 11 extruded from the nozzles 3 to the right in FIG. 1.

An air stream vibrating mechanism 9 in the form of a rotatable bar having an elliptic cross section is disposed in the vicinity of the melt-blow die 1 in a region where the high-speed air stream is produced from the slits 6*a*, 6*b*. The air stream vibrating mechanism 9 has a shaft 9*a* extending substantially perpendicularly to the direction in which the filaments 11 are fed on the conveyor 7, i.e., substantially parallel to the transverse direction of a nonwoven fabric to be manufactured. When the shaft 9*a* is rotated about its own axis, the air stream vibrating mechanism 9 is rotated about the shaft 9*a* in the direction indicated by the arrow A. When the air stream vibrating mechanism 9 disposed in the region where the high-speed air stream flows is rotated, the direction in which the filaments 11 flow can be changed.

The filaments 11 flow along the high-speed air stream which is a combined flow of the air ejected from the slits 6*a*, 6*b*. The high-speed air stream flows in a direction substantially perpendicular to the plane in which the filaments 11 are fed by the conveyor 7.

It is generally known that if there is a wall near a high-speed jet of air or liquid, the jet tends to flow along the wall surface even when the direction of the jet's axis and the direction of the wall surface differ from each other. Such a phenomenon is referred to as the Coanda effect. The air stream vibrating mechanism 9 changes the direction of the flow of the filaments 11 based on the Coanda effect.

The behavior of the direction of the flow of the filaments 11 upon rotation of the air stream vibrating mechanism 9 will be described below with reference to FIGS. 2*a* through 2*c*.

Figure 2A:
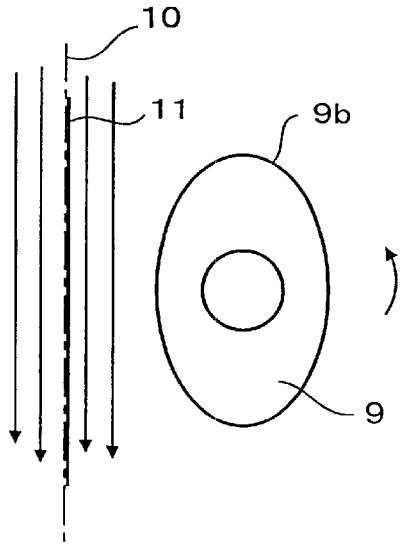
FIGS. 2*a* through 2*c* are diagrams showing the manner in which a flow of filaments is changed in direction by the rotation of an air stream vibrating mechanism in the apparatus shown in FIG. 1.

In FIG. 2*a*, the elliptic end of the air stream vibrating mechanism 9 has a major axis substantially parallel to the axis 10 of the high-speed air stream, and the air stream vibrating mechanism 9 has a peripheral wall surface 9*b* spaced from the air stream axis 10 by a maximum distance. At this time, the Coanda effect due to the peripheral wall surface 9*b* of the air stream vibrating mechanism 9 is minimum, and the high-speed air stream flows substantially along the air stream axis 10, and the filaments 11 also flow substantially along the air stream axis 10.

Figure 2B:
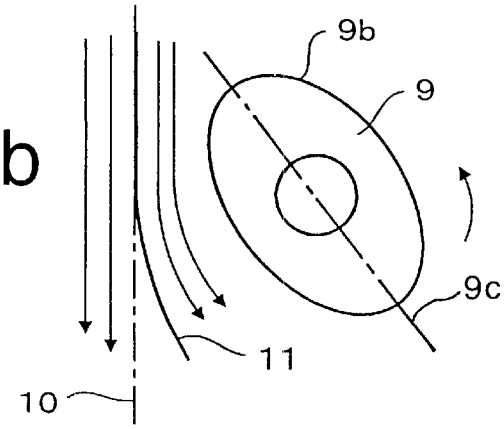

When the air stream vibrating mechanism 9 is turned about the shaft 9*a* to tilt the major axis 9*c* of the elliptic end of the air stream vibrating mechanism 9 with respect to the air stream axis 10, as shown in FIG. 2*b*, the distance between the peripheral wall surface 9*b* and the air stream axis 10 becomes progressively smaller, and the Coanda effect grows larger. Since the air stream vibrating mechanism 9 is in the form of a rotatable bar having an elliptic cross section, the distance between the peripheral wall surface 9*b* and the air stream axis 10 is progressively greater downstream in the direction of the high-speed air stream. Therefore, the high-speed air stream tends to flow along the peripheral wall surface 9*b*, attracting the filaments 11 toward the air stream vibrating mechanism 9.

Figure 2C:
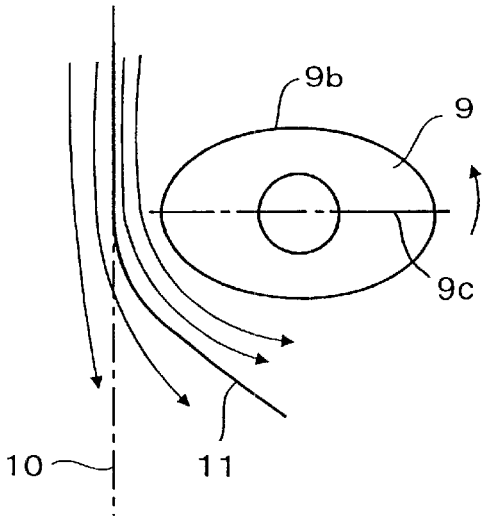

When the air stream vibrating mechanism 9 is further turned about the shaft 9*a* to direct the major axis 9*c* perpendicularly to the air stream axis 10, as shown in FIG. 2*c*, the distance between the peripheral wall surface 9*b* and the air stream axis 10 becomes minimum. At this time, the Coanda effect is maximum. Downstream of the position where the peripheral wall surface 9*b* is closest to the air stream axis 10, the angle of the peripheral wall surface 9*b* with respect to the air stream axis 10 is greater than the angle shown in FIG. 2*b*. Consequently, the filaments 11 are more attracted toward the air stream vibrating mechanism 9 than they are in FIG. 2*b*.

Upon continued rotation of the air stream vibrating mechanism 9 from the angular position shown in FIG. 2*c*, the distance between the peripheral wall surface 9*b* and the air stream axis 10 is progressively greater, and the angle of the peripheral wall surface 9*b* with respect to the air stream axis 10 becomes smaller, directing the flow of the filaments 11 more parallel to the air stream axis 10. When the air stream vibrating mechanism 9 is turned 180° from the angular position shown in FIG. 2*a*, the air stream vibrating mechanism 9 reaches the angular position shown in FIG. 2*a*. Thereafter, the above continuous process is repeated.

In this manner, the filaments 11 can periodically be vibrated in the range shown in FIGS. 2*a* through 2*c*. Since the shaft 9*a* of the air stream vibrating mechanism 9 extends substantially perpendicularly to the direction in which the filaments 11 are fed on the conveyor 7, the filaments 11 are vibrated in the direction in which the filaments 11 are fed on the conveyor 7, i.e., in their longitudinal direction.

In the above illustrated embodiment, the air stream vibrating mechanism 9 rotates in the same direction as the flow of the filaments 11. However, the air stream vibrating mechanism 9 may rotate in the opposite direction to the flow of the filaments 11 insofar as the air stream vibrating mechanism 9 can periodically change the distance between the air stream and the peripheral wall surface 9*b*. Alternatively, the air stream vibrating mechanism may have its peripheral wall surface moved by vibration, rather than rotation.

The width of the air stream vibrating mechanism 9, i.e., the length thereof parallel to the shaft 9*a*, should preferably be greater than the width of the group of filaments 11 produced by the melt-blow die 1 (see FIG. 1) by 100 mm or greater. If the width of the air stream vibrating mechanism 9 were smaller than the above size, then it would fail to sufficiently change the direction of the high-speed air stream at the opposite ends of the group of filaments 11, tending to longitudinally align the filaments 11 insufficiently at the opposite ends of the group of filaments 11. The minimum distance between the peripheral wall surface 9*b* and the air stream axis 10 is 25 mm or less, or preferably 15 mm or less. If the minimum distance between the air stream vibrating mechanism 9 and the air stream axis 10 were greater than the above distance, the effect of attracting the high-speed air stream to the air stream vibrating mechanism 9 would be too small to vibrate the filaments 11 sufficiently.

The extent to which the filaments 11 are vibrated depends on the speed of the high-speed air stream and the rotational speed of the air stream vibrating mechanism 9. Specifically, if variations of the distance of the peripheral wall surface 9*b* of the air stream vibrating mechanism 9 from the air stream axis 10 of the high-speed air stream are considered to be vibrations of the peripheral wall surface 9*b* of the air stream vibrating mechanism 9, then there exists the particular frequency, of the peripheral wall surface 9*b* which makes maximum the extent to which the filaments 11 are vibrated. The particular number of vibrations differs depending on spinning conditions. If the number of vibrations of the peripheral wall surface 9*b* were different from the above particular number of vibrations, then since the number of vibrations of the peripheral wall surface 9*b* would be different from the inherent number of vibrations of the high-speed air stream, the effect of accelerating the high-speed air stream would be reduced, thus reducing the extent to which the filaments 11 are vibrated. If the number of vibrations of the peripheral wall surface 9*b* were an integral multiple of the above particular number of vibrations, the effect of accelerating the high-speed air stream would be small though the number of vibrations of the peripheral wall surface 9*b* would be equal to the inherent number of vibrations of the high-speed air stream. In this embodiment, the air stream vibrating mechanism 9 is rotated in order to maximize the extent to which the filaments 11 are vibrated.

The speed of the high-speed air stream is 10 m/sec. or higher, or preferably 15 m/sec. or higher. If the speed of the high-speed air stream were smaller than the above value, the high-speed air stream would fail to be sufficiently attracted to the air stream vibrating mechanism 9, with the result that the filaments 11 would not sufficiently be vibrated.

Referring back to FIG. 1, a spray nozzle 8 is disposed between the melt-blow die 1 and the conveyor 7. The spray nozzle 8 sprays a mist of water into the high-speed air stream to cool the filaments 11 to solidify the filaments 11 quickly. Only one spray nozzle 8 is illustrated though a plurality of spray nozzles 8 are employed.

The solidified filaments 11 are stacked on the conveyor 7 while being vibrated in the longitudinal direction, and partially folded over themselves in the longitudinal direction and successively collected on the conveyor 7.

The filaments 11 on the conveyor 7 are delivered to the right by the conveyor 7, nipped by the stretching roll 12*a* heated to a stretching temperature and a presser roller 14, and transferred onto the stretching roller 12*a*. Thereafter, the filaments 11 are nipped by the stretching roller 12*b* and a presser rubber rollers 15, and transferred onto the stretching roller 12*b*. The filaments 11 are now held in close contact with the stretching rollers 12*a*, 12*b*. Since the filaments 11 are delivered in close contact with the stretching rollers 12*a*, 12*b*, the adjacent ones of the filaments 11 that are partially folded over themselves in the longitudinal direction are fused to each other, thereby producing a web.

The web produced while being delivered in close contact with the stretching rollers 12*a*, 12*b* is withdrawn by the withdrawal nip rollers 16*a*, 16*b*. The rear withdrawal nip roller 16*b* is made of rubber. The peripheral speed of the withdrawal nip rollers 16*a*, 16*b* is greater than the peripheral speed of the stretching rollers 12*a*, 12*b*, so that the web is stretched longitudinally into a longitudinally stretched nonwoven fabric 18.

As described above, the air stream vibrating mechanism 9 changes the direction of the high-speed air stream in the longitudinal direction to vibrate the filaments 11 in the longitudinal direction and stack the filaments 11 on the conveyor 7. Therefore, the longitudinal alignability of the filaments 11 is improved, and the length by the filaments 11 are folded over themselves on the conveyor 7 can be increased. For example, according to the device disclosed in Japanese laid-open patent publication No. 204767/98, the length by the filaments 11 are folded over themselves on the conveyor 7 is about 100 mm. According to the present invention, the filaments 11 can easily folded over themselves on the conveyor 7 by a length of 300 mm or more. The above alignment of the filaments 11 is effective to increase the mechanical strength of the filaments 11 in the longitudinal direction.

The alignability of the filaments 11 in the longitudinal direction can further be improved by stretching the web in the longitudinal direction. The better the alignability of the filaments 11 in the longitudinal direction, the higher the probability that the filaments 11 are substantially stretched when the web is stretched in the longitudinal direction, and the greater the mechanical strength of the finally stretched web. If the alignment of the filaments 11 were poor, then only the distance between the folded structures of the filaments 11 and the distance between the filaments 11 would be increased by stretching the web, and the probability that the filaments 11 are substantially stretched would be lowered, failing to attain a sufficient mechanical strength after stretching the web.

The increased length by the filaments 11 are folded over themselves on the conveyor 7 is effective not only in aligning the filaments 11 in the longitudinal direction, but also in making it possible to stretch the web to achieve a sufficient mechanical strength even if the stretching distance is long in a proximity stretching process, described later on.

In the ordinary melt-blow spinning process, since the filaments and hot air linearly impinge upon the conveyor, the time in which the filaments reach the conveyor, i.e., the cooling time, is short. If the distance between the nozzles and the conveyor is too large, then the formation of the web, i.e., the partial uniformity of the weight, is poor. According to the ordinary melt-blow spinning process, the distance between the nozzles and the conveyor is about 300 mm. According to the present invention, since the filaments are largely vibrated, the time in which the filaments reach the conveyor 7 is so long that the filaments can well be cooled without the need for increasing the distance between the nozzles and the conveyor. An experimental result indicated that the formation of the web was improved though the reason is not necessarily clear.

The produced longitudinally aligned nonwoven fabric 18 may further be stretched or subsequently treated for heating or partial bonding such as heat embossing or the like, if necessary.

According to the present embodiment, as described above, the alignability of the filaments is further improved by stretching the produced web in the longitudinal direction. Therefore, the spinning device may produce a web of filaments of good alignability. To that end, it is necessary to cool the filaments sufficiently quickly to produce a web of filaments that have small stretching stresses and are stretched largely. The most effective way to meet such a requirement is to spray a mist of water from the spray nozzle 8 to introduce the mist into the high-speed air stream, as described above.

Adding a lubricant, referred to as a spinning/stretching lubricant, for imparting stretching and static electricity removing properties to the mist is effective to improve the subsequent stretching of the web, reducing fibers, and increasing the mechanical strength and elongation of the stretched web. The fluid ejected from the spray nozzle 8 may not necessarily contain water insofar as it can cool the filaments 11, but may be cooled air.

The stretching magnification of the web differs depending on the type of the polymer of the filaments which make up the web, the spinning device and the aligning device for the web, the desired mechanical strength and elongation in the longitudinal and transverse directions, etc. Regardless of which type and device are employed, the stretching magnification is selected to achieve the desired high stretching ability and mechanical strength of the web. By stretching the web at a greater magnification than ordinary nonwoven fabric's stretch, the filaments can be attenuated, thus providing a nonwoven fabric of fine denier whose feel and filter characteristics are improved.

The stretching magnification is defined according to marks applied to the web to be stretched at constant intervals in the direction in which the web is to be stretched, by the following equation:

Stretching magnification=[Length between the marks on the stretched web]/[Length between the marks on the web to be stretched]

The term "stretching magnification" used herein may not necessarily mean the stretching magnification of each filament as is the case with the stretching of ordinary long-fiber filament yarn.

In the above embodiment, the apparatus has only one air stream vibrating mechanism 9. However, if necessary, the apparatus may have a plurality of air stream vibrating mechanisms 9 for increasing the extent to which the filaments 11 are vibrated.

Other embodiments of the filaments, the spinning device, the stretching device and the air stream vibrating mechanism that can be used in the present invention will be described below.

<Filaments>

Polymers that are suitable for the filaments according to the present invention comprise thermoplastic resins including polyethylene, polypropylene, polyester, polyamide, polyvinyl chloride resins, polyurethane, fluoroplastics, and modified resins thereof. In addition, resins for use with wet- or dry-type spinning device, such as polyvinyl alcohol resins, polyacrylonitrile resins, etc.

According to the present invention, filaments comprising different types of polymers and conjugate filaments as disclosed in International Publication WO96/17121 by the present applicant may also be used.

The web may be increased in width while the longitudinal alignment of the filaments are being maintained. With the web width increased, the filaments are obliquely crossed.

The filaments according to the present invention are long-fiber filaments. The long-fiber filaments may be essentially long fibers whose average length exceeds 100 mm. If the diameter of filaments immediately after they are spun were 50 $\mu$m or more, the filaments would be stiff and would not be intertwined sufficiently. According to the present invention, the diameter of filaments is preferably 30 $\mu$m or less, or more preferably 25 $\mu$m or less. If a nonwoven fabric of increased mechanical strength is desired, then the diameter of filaments after being stretched should preferably be 5 $\mu$m or more. The diameter and length of filaments are measured by enlarged microscopic photography.

<Spinning Device>

The spinning device for the filaments 11 has been described as the melt-blow process that is a spunbond process in a wide sense. An embodiment that employs a spunbond process in a narrow sense will be described below.

Figure 3:
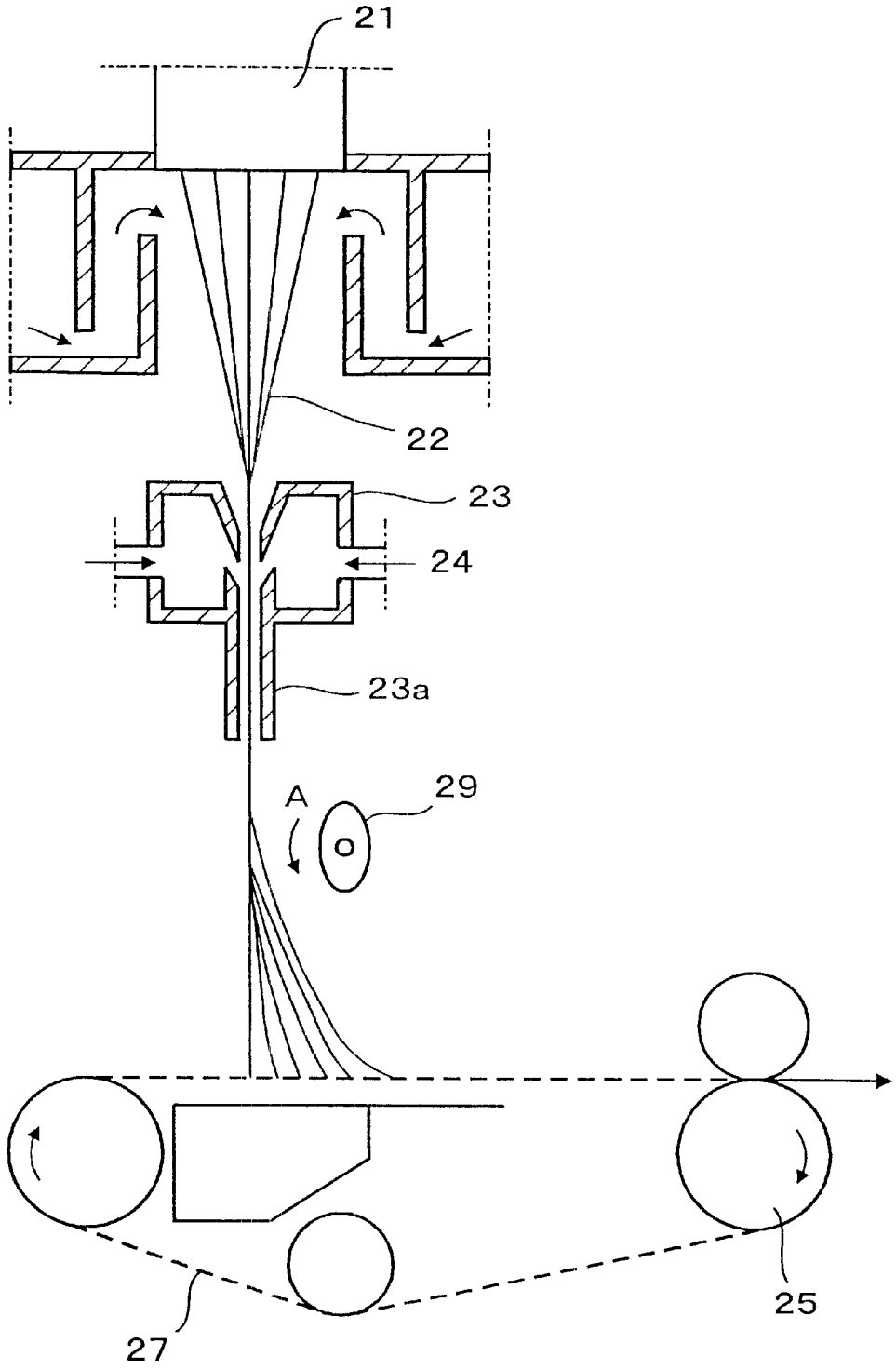
FIG. 3 is a schematic elevational view of an apparatus for manufacturing a nonwoven fabric in a spunbond process according to the present invention.

FIG. 3 schematically shows an apparatus for manufacturing a nonwoven fabric according to a spunbond process in a narrow sense. According to an ordinary spunbond spinning process, a plurality of filaments 22 spun from a spunbond die 21 having a plurality of spinning holes are stretched by air 24 ejected from an ejector 23, and guided by a high-speed air stream accelerated by a nozzle 23a of the ejector 23 and stacked onto a conveyor 27. The conveyor 27 is driven by a conveyor roller 25 to deliver the filaments 22 to the right in FIG. 3.

An air stream vibrating mechanism 29 having an elliptic cross section is disposed between the ejector 23 and the conveyor 27 in a region where the high-speed air stream flows. The air stream vibrating mechanism 29 has the same structure as the air stream vibrating mechanism shown in FIG. 1. When the air stream vibrating mechanism 29 rotates in the direction indicated by the arrow A as shown in FIGS. 2*a* through 2*c*, it periodically changes the direction of the high-speed air stream in the direction in which the filaments 22 are fed by the conveyor 27. The filaments 22 discharged from the ejector 23 flow along the high-speed air stream whose direction changes periodically, are partially folded over themselves in the longitudinal direction, collected on the conveyor 27, and delivered by the conveyor 27. The filaments 22 that are longitudinally aligned and collected on the conveyor 27 are subsequently embossed with heat, if necessary, resulting in a product.

If the spinning device according to the present invention carries out a spunbond process in a narrow sense or a spunlace process, then the molecular orientation of the filaments 11 may have already been performed. According to the present invention, even in such a case, the alignment of the filaments can greatly be improved for producing a nonwoven fabric which is strong in the longitudinal direction.

If the molecular orientation of the filaments is large, then the filaments have no elongation and their stretching tension is high, making it difficult to subsequently stretch the filaments at a high magnification. For subsequently stretching the filaments at a high magnification, it is effective to cool the filaments immediately below the nozzle to reduce the molecular orientation of the filaments, as disclosed in Japanese laid-open patent publication No. 204767/98.

One spinning device for producing a spunbond nonwoven fabric in a narrow sense comprises a process of bringing filaments into collision with a collision plate (see Japanese patent publications Nos. 4026/74 and 24261/93, for example). The collision plate serves to split and spread the filaments to reduce the anisotropy of the web on the conveyor. The air stream vibrating mechanism according to the present invention serves to increase the anisotropy of the web, i.e., align the filaments well in one direction. Therefore, the air stream vibrating mechanism differs from the collision plate as to its object and effect. Furthermore, the air stream vibrating mechanism according to the present invention also differs from the collision plate as to its operation because the air stream vibrating mechanism is not brought into direct contact with the filaments, but changes the direction of the high-speed air stream in its region, and changes the position of the wall surface thereof in very short periods.

<Stretching Device>

Various stretching device, other than the stretching device shown in FIG. 1, for stretching the web produced by the spinning device in the longitudinal direction can be employed.

The web is primarily stretched in multiple stages though it may be stretched in one stage. In the multiple-stage stretching process, the web is stretched in the first stage for preliminary stretching immediately after spinning. The second and subsequent stretching stages are used as main stretching stages. According to the present invention, a proximity stretching process is suitable for use in the first stretching state of the multiple-stage stretching process.

The proximity stretching process is a stretching process in which the web is stretched by the difference between the surface speeds of two adjacent rollers, and the stretching distance, i.e., the distance from a point where the web starts being stretched to a point where the web ends being stretched, is sufficiently smaller than the width of the web. According to an ordinary proximity stretching process, the stretching distance is 100 mm or less. According to the present invention, since the length by the filaments are folded over themselves is very large, it was experimentally confirmed that the proximity stretching process was effective enough though the stretching distance was several hundreds mm.

With the large stretching distance, it is possible to increase the diameters of the stretching rollers and the presser rollers. As a result, the stretching device can be designed with ease, and the filaments in the web are prevented from being fixedly wound on the rollers.

In the proximity stretching process, heat is generated usually by heating the stretching rollers, and the stretching points are additionally heated by hot air or infrared radiation.

The heat source in the proximity stretching process may be hot water, steam, or the like.

In the multiple-stage stretching process, not only the proximity stretching process, but also various device for stretching ordinary webs, i.e., a cluster of fibers or filaments of nonwoven fabrics, may be used in the second and subsequent stretching stages. For example, roller stretching, hot-water stretching, steam stretching, hot-plate stretching, rolling stretching, etc. may be used. The proximity stretching process may not necessarily be required because the individual filaments already extend long in the longitudinal direction in the first stretching stage.

<Air Stream Vibrating Mechanism>

Air stream vibration mechanisms of any structures may be employed insofar as they can periodically change the direction of the high-speed air stream to draft the filaments in the longitudinal direction.

Various embodiments of air stream vibration mechanisms will be described below.

Figure 4A:
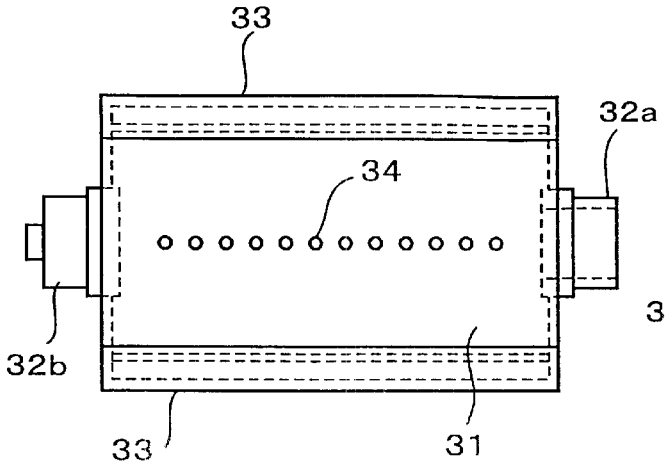
FIG. 4*a* is a front elevational view of an air stream vibrating mechanism having a rotatable cylindrical bar.
Figure 4B:
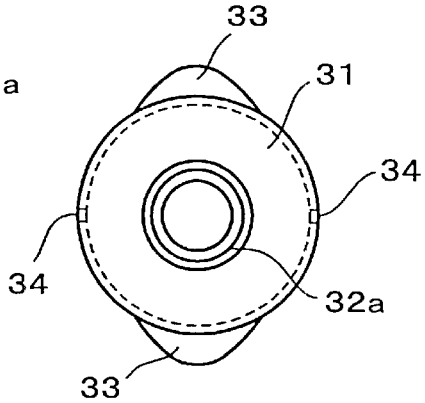
FIG. 4*b* is a side elevational view of the air stream vibrating mechanism shown in FIG. 4*a;*

FIGS. 4*a* and 4*b* show an air stream vibrating mechanism having a rotatable cylindrical bar. The air stream vibrating mechanism has a cylindrical body 31 as a main component. Shafts 32*a*, 32*b* are integrally mounted on respective opposite ends of the cylindrical body 31 coaxially with the axis thereof. The shafts 32*a*, 32*b* are rotatably supported and rotated by an actuator, not shown, for thereby rotating the cylindrical body 31 about its own axis. The cylindrical body 31 has two projections 33 integrally mounted on a circumferential wall surface thereof and having tip ends constructed as curved surfaces. The projections 33 are positioned in diametrically opposite relation across the cylindrical body 31 and extend in the axial direction of the cylindrical body 31.

When the air stream vibrating mechanism rotates, the circumferential wall surface of the cylindrical body 31 and the projections 33 alternately face the air-stream axis of the high-speed air stream. When the circumferential wall surface of the cylindrical body 31 faces the air-stream axis, the distance between the circumferential wall surface and the air-stream axis is sufficiently large, not affecting the flow of the high-speed air stream. When the air stream vibrating mechanism further rotates, causing one of the projections 33 to start facing the air stream axis, the distance between the circumferential wall surface and the air-stream axis becomes progressively smaller, and the high-speed air stream flows along the surface of the projection 33 due to the Coanda effect. Therefore, the filaments flowing along the high-speed air stream are attracted to the air stream vibrating mechanism. As a result, the filaments are periodically vibrated in the same manner as with the arrangement shown in FIG. 1.

As shown in FIGS. 4*a* and 4*b*, the circumferential wall surface of the cylindrical body 31 may have a plurality of holes 34 defined therein along the axis thereof ejecting air therefrom. When air is ejected from the holes 34, the direction of the high-speed air stream may be changed away from the air stream vibrating mechanism for thereby increasing the extent to which the filaments are vibrated. If air is to be ejected from the holes 34, then one of the shafts 32*a* comprises a hollow shaft, and air is supplied from the shaft 32*a* into the cylindrical body 31. Although not shown, the projections 33 may have holes defined therein, and air may be attracted from the holes to introduce part of the high-speed air stream, making it easy for the high-speed air stream to flow along the projections thereby to increase the extent to which the filaments are vibrated.

Figure 5A:
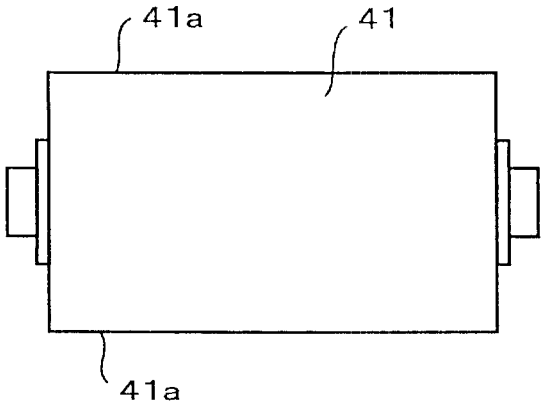
FIG. 5*a* is a front elevational view of an air stream vibrating mechanism having a rotatable bar in the shape of a triangular prism.
Figure 5B:
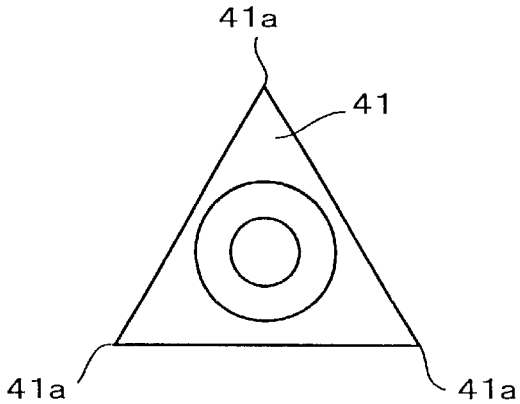
FIG. 5*b* is a side elevational view of the air stream vibrating mechanism shown in FIG. 5*a;*

FIGS. 5*a* and 5*b* shows an air stream vibrating mechanism having a triangular cross-sectional shape. The air stream vibrating mechanism shown in FIGS. 5*a* and 5*b* has a rotatable bar 41 in the shape of a triangular prism. The rotatable bar 41 is rotated to change the direction of the high-speed air stream. Upon rotation of the rotatable bar 41, when an edge 41*a* of the rotatable bar 41 moves toward the air stream axis of the high-speed air stream, the high-speed air stream tends to flow along a wall surface downstream of the edge. 41*a*, and when the edge 41*a* moves away from the air stream axis, the high-speed air stream tends to flow without being affected by the wall surface of the rotatable bar 41. When the direction of the high-speed air stream is thus changed, the filaments are vibrated in the longitudinal direction.

In FIGS. 5*a* and 5*b*, the air stream vibrating mechanism having a triangular cross-sectional shape is illustrated. However, the air stream vibrating mechanism may have a rotatable bar of a regular polygonal cross-sectional shape such as a regular square or pentagonal cross-sectional shape. Those rotatable bars offer the same advantages as described above as they can periodically change the distance between the air stream axis of the high-speed air stream and the wall surface of the air stream vibrating mechanism.

Figure 6A:
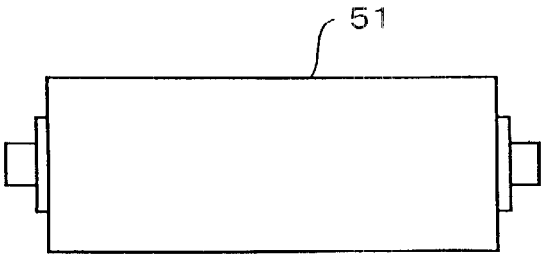
FIG. 6*a* is a front elevational view of an air stream vibrating mechanism having a rotatable bar in the shape of a quadrangular prism.
Figure 6B:
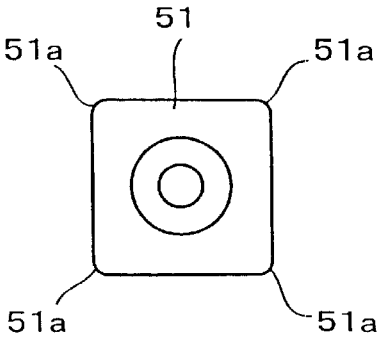
FIG. 6*b* is a side elevational view of the air stream vibrating mechanism shown in FIG. 6*a;*

FIGS. 6*a* and 6*b* show an air stream vibrating mechanism having a square cross-sectional shape. The air stream vibrating mechanism shown in FIGS. 6*a* and 6*b* is a modification of the air stream vibrating mechanism shown in FIGS. 5*a* and 5*b*. The air stream vibrating mechanism shown in FIGS. 6*a* and 6*b* has a rotatable bar 51 in the shape of a quadrangular prism. The rotatable bar 51 has edges 51*a* each machined into a curved surface which allows adjacent side wall surfaces to blend smoothly into each other. When an edge 51*a* moves toward and away from the air stream axis of the high-speed air stream, the direction of the high-speed air stream smoothly changes. The side wall surfaces may also be curved to offer the same advantage as described above.

Figure 7:
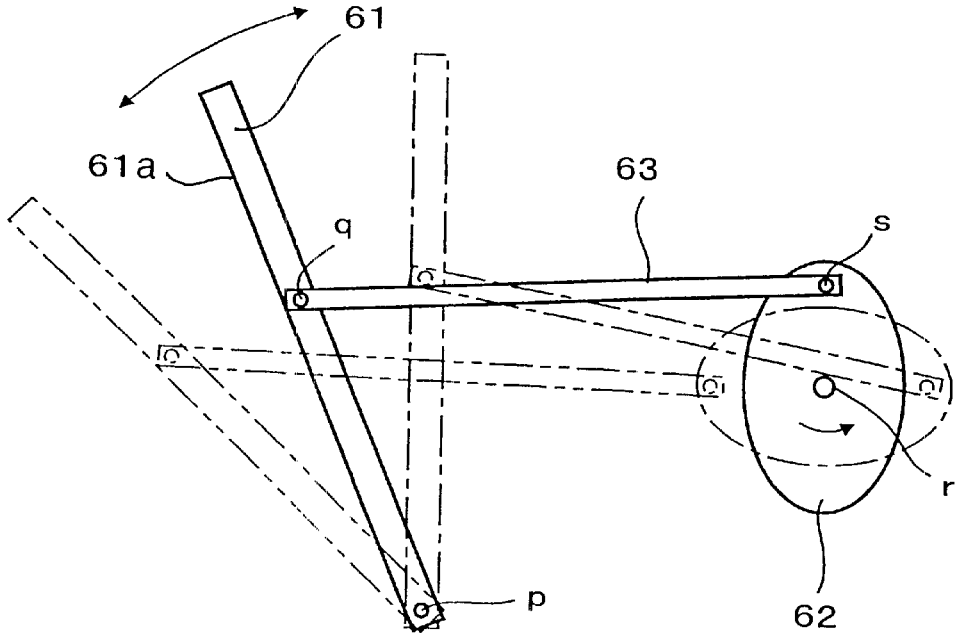
FIG. 7 is a side elevational view of an air stream vibrating mechanism having a swingable plate member.

FIG. 7 shows in side elevation an air stream vibrating mechanism for changing the direction of the high-speed air stream by swinging movement, rather than rotation. In FIG. 7, a plate 61 having a principal surface 61*a* which faces the high-speed air stream is supported at its lower end on a shaft extending parallel to the transverse direction of a nonwoven fabric to be manufactured. The plate 61 is thus angularly movable about a point p on its lower end. The plate 61 is coupled at a vertically intermediate point thereon to a connecting rod 63 which is connected to a rotatable member 62 rotatable about a rotatable shaft r. The connecting rod 63 has an end connected swingably to the rotatable member 62 at an eccentric point s thereon, and an opposite end connected swingably to the plate 62 at the vertically intermediate point q.

When the rotatable member 62 rotates, the plate 61 is angularly moved about the point p in an angular range between a dot-and-dash-line position and a two-dot-and-dash-line position. The angular range of the plate 61, i.e., the distance between the rotatable shaft r and the eccentric point s and the distance between the points p, q are selected such that when the upper end of the plate 61 is displaced most remotely from the air stream axis, the principal surface 61*a* of the plate 61 lies substantially parallel to the air stream axis. Therefore, when the plate 61 is in the dot-and-dash-line position, the high-speed air stream has its direction unchanged. As the upper end of the plate 61 is moved toward the air stream axis, tilting the principal surface 61*a* of the plate 61, the high-speed air stream tends to flow along the main surface 61*a*, changing its direction to the right. Therefore, when the plate 61 is angularly moved, the direction of the high-speed air stream is periodically changed.

Figure 8:
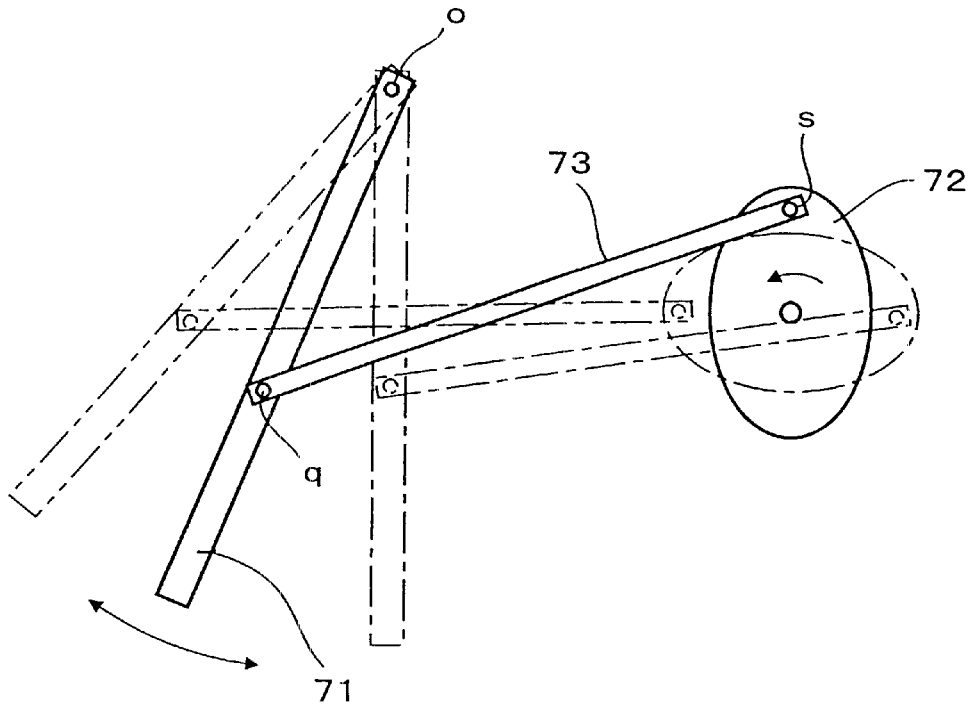
FIG. 8 is a side elevational view of another air stream vibrating mechanism having a swingable plate member.

FIG. 8 shows an air stream vibrating mechanism which is angularly movable for changing the direction of the high-speed air stream. The air stream vibrating mechanism shown in FIG. 8 differs from the air stream vibrating mechanism shown in FIG. 7 in that a plate 71 is swingably movable about a point o on its upper end, rather than its lower end. The air stream vibrating mechanism shown in FIG. 8 is the same as the air stream vibrating mechanism shown in FIG. 7 with respect to other details, i.e., in that the plate 71 is connected to a rotatable member 72 by a connecting rod 73, the connecting rod 73 is connected to the plate 71 at the point q, and the connecting rod 73 is connected to the rotatable member 72 at the eccentric point s. The plate 71 is angularly movable about the point o in an angular range between a dot-and-dash-line position and a two-dot-and-dash-line position.

When the plate 71 is thus angularly moved, the plate 71 does not pull the high-speed air stream, but pushes the high-speed air stream for thereby periodically changing the direction of the high-speed air stream.

In the embodiments shown in FIGS. 7 and 8, each of the plates 61, 71 comprises a flat plate. However, curved plates may be used in order to increase the extent to which the high-speed air stream is vibrated, i.e., the extent to which the filaments are vibrated.

In the above embodiments, the apparatus has only one air stream vibrating mechanism. However, the apparatus may have a plurality of air stream vibrating mechanisms which are simultaneously operated to increase the extent to which the filaments are vibrated or control the point where the filaments are placed onto the collecting device.

Figure 9:
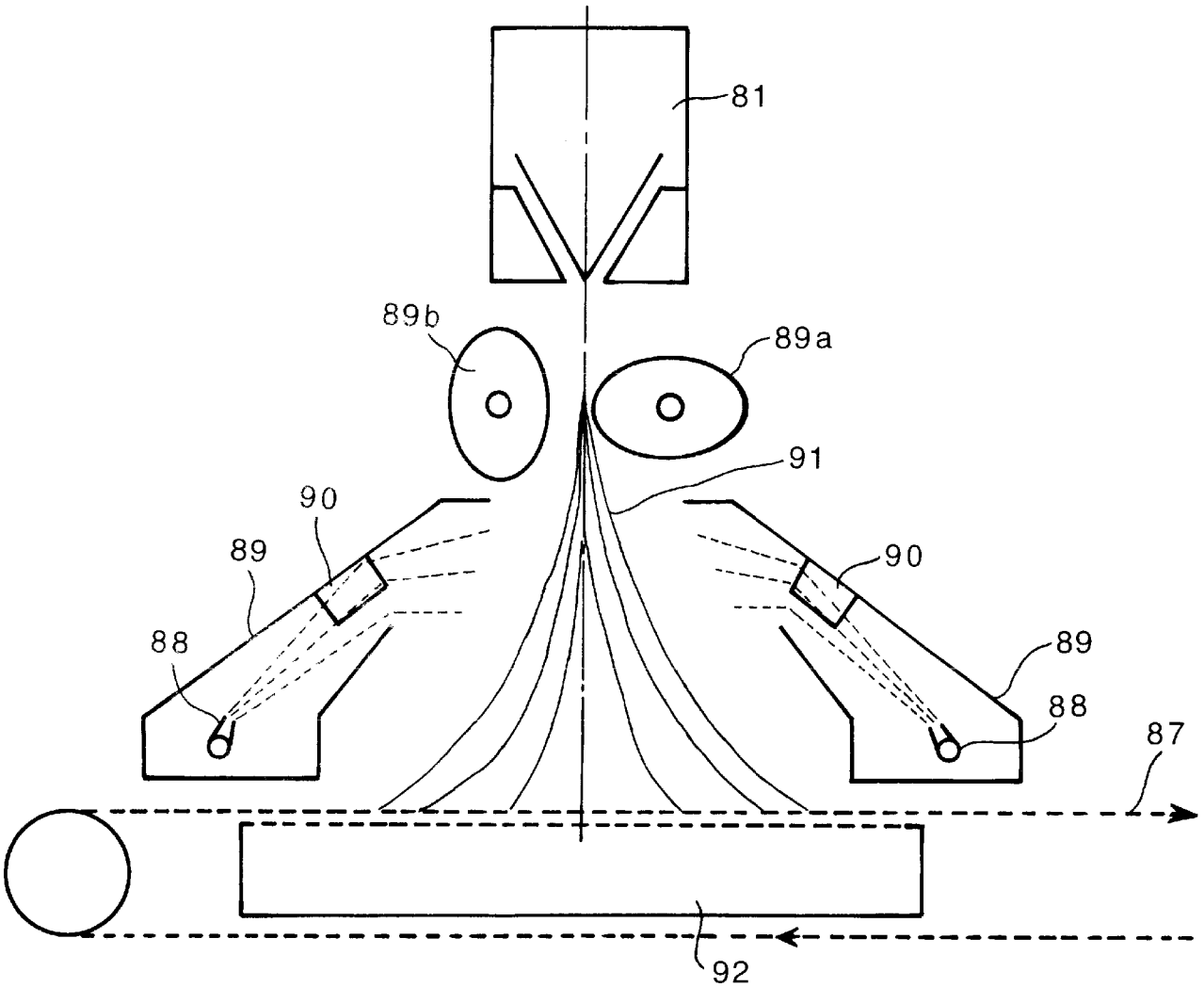
FIG. 9 is a schematic elevational view of an apparatus for manufacturing a nonwoven fabric, the apparatus having two air stream vibrating mechanisms.

FIG. 9 shows an apparatus for manufacturing a nonwoven fabric, the apparatus having two parallel air stream vibrating mechanisms each having an elliptic cross-sectional shape. The apparatus shown in FIG. 9 comprises a melt-blow die 81, a pair of air stream vibrating mechanisms 89*a*, 89*b*, a pair of cooling boxes 89, and a conveyor 87. A stretching unit is omitted from illustration in FIG. 9.

Each of the air stream vibrating mechanisms 89*a*, 89*b* comprises a rotatable bar having an elliptic cross-sectional shape. The air stream vibrating mechanisms 89*a*, 89*b* have respective rotatable shafts extending perpendicularly to the direction in which filaments 91 are fed on the conveyor 87, and disposed parallel to each other symmetrically with respect to the air stream axis of the high-speed air stream produced by a melt-blow die 82. The dot-and-dash line in FIG. 9 indicates the air stream axis. The air stream vibrating mechanisms 89*a*, 89*b* have vertexes which are angularly out of phase with each other by 90°, and are rotated in synchronism with each other.

The cooling boxes 89 are disposed downwardly of the air stream vibrating mechanisms 89*a*, 89*b* and each have a spray nozzle 88 for spraying a mist of water into the high-speed air stream to cool the filaments 91 and a flow rectifying plate 90. The conveyor 87 comprises a mesh conveyor with a suction box 92 for attracting the filaments 91 being disposed behind a region where the filaments 91 are collected. The suction box 92 allows the conveyor 87 to collect the filaments 91 reliably.

The filaments 91 extruded from the melt-blow die 81 and carried by the high-speed air stream pass between the air stream vibrating mechanisms 89*a*, 89*b*. At this time, since the air stream vibrating mechanisms 89*a*, 89*b* are rotated synchronously out of phase with each other by 90°, the air stream vibrating mechanisms 89*a*, 89*b* alternately pull and push the filaments 91 due to the Coanda effect as described above with reference to FIGS. 2*a* through 2*c*. As a result, because the Coanda effect provided by both the air stream vibrating mechanisms 89*a*, 89*b* more effectively takes place, the extent to which the filaments 91 are vibrated is increased, resulting in an improvement in the alignability of the filaments 91 in the longitudinal direction.

In the embodiment shown in FIG. 9, the air stream vibrating mechanisms 89*a*, 89*b* are arranged out of phase with each other by 90°. However, the air stream vibrating mechanisms 89*a*, 89*b* do not need to be arranged out of phase with each other by 90° insofar as they are arranged out of phase with each other to alternately attract the filaments 91. In the embodiment shown in FIG. 9, each of the pair of air stream vibrating mechanisms 89*a*, 89*b* has an elliptic cross-sectional shape. However, the number and type of the air stream vibrating mechanisms 89*a*, 89*b* are not limited insofar as they are arranged to increase their Coanda effect. The various mechanisms shown above may be selected and combined with each other.

While some preferable air stream vibrating mechanisms capable of changing the direction of the high-speed air stream by rotation or changing the direction of the high-speed air stream by swinging movement have been described above, the present invention is not limited to the illustrated air stream vibrating mechanisms, but may employ an air stream vibrating mechanism which has a wall surfaces inclined to the air stream axis of the high-speed air stream and can be translated to change the distance between the wall surface and the air stream axis of the high-speed air stream for thereby producing the Coanda effect.

The nonwoven fabric manufactured according to the present invention may be used as a nonwoven fabric for an electric wire winding tape, a nonwoven fabric for a package tape ribbon, a nonwoven fabric impregnated with a pressure-sensitive adhesive, or the like. The nonwoven fabric may also be used to reinforce ordinary nonwoven fabrics, paper, etc. with an improved hand. Furthermore, the nonwoven fabric manufactured according to the present invention may be used alone, or may be used as laminated on paper, nonwoven fabric, film, cloth, etc. for reinforcing the mechanical strength thereof in the longitudinal direction.

The longitudinally stretched nonwoven fabric manufactured according to the present invention is glossy and hence can be used as package materials which utilize the gloss as a feature. The longitudinally stretched nonwoven fabric manufactured according to the present invention may be used as a material web for perpendicularly crossed laminated nonwoven fabrics and obliquely crossed laminated nonwoven fabrics as disclosed in Japanese patent publication No. 36948/91, Japanese laid-open patent publication No. 269859/90, Japanese laid-open patent publication No. 269860/90, and International Publication WO96/17121 which are prior inventions made by the present inventors.

Examples of the present invention will be described below in specific detail. In the examples, longitudinally stretched nonwoven fabrics were manufactured under conditions described below, and evaluated for their properties.

Inventive Example 1-1

In this example, a longitudinally stretched nonwoven fabric was manufactured by an apparatus which is the same as the apparatus shown in FIG. 1. The melt-blow die had spinning nozzles having a nozzle diameter of 0.38 mm, a nozzle pitch of 1.0 mm, and a spinning width of 500 mm. Filaments were made of a polyethylene terephthalate resin having an intrinsic viscosity of 0.57 dl/g. The melt-blow die extruded filaments at a discharge rate of 0.33 g/min. per nozzle at a die temperature of 320° C. A high-speed air stream was ejected to draft the extruded filaments to attenuate the filaments at a temperature of 400° C. at a rate of 2000 Nl/min. A mist of water was sprayed from the spray nozzle to cool the filaments.

An air stream vibrating mechanism of the type shown in FIGS. 4*a* and 4*b* was used so as to be spaced from the extension of the nozzles of the melt-blow die by the distance of 15 mm at minimum. The rotational speed of the air stream vibrating mechanism was measured, and the air stream vibrating mechanism was rotated such that the number of vibrations, or frequency, of the wall surface was 20.0 Hz. The filaments were collected on the conveyor in a longitudinally aligned state. The filaments collected on the conveyor were heated by the stretching rollers, and stretched longitudinally by 5.5 times into a longitudinally stretched nonwoven fabric.

Inventive Example 1-2

The same apparatus as in Inventive Example 1-1 was used to manufacture a longitudinally stretched nonwoven fabric under the same conditions as in Example 1-1 except that the rotational speed of the air stream vibrating mechanism was changed. The rotational speed of the air stream vibrating mechanism was selected such that the number of vibrations, or frequency, of the wall surface was 11.7 Hz.

Inventive Example 1-3

The same apparatus as in Inventive Example 1-1 was used to manufacture a longitudinally stretched nonwoven fabric under the same conditions as in Example 1-1 except that the rotational speed of the air stream vibrating mechanism was changed. The rotational speed of the air stream vibrating mechanism was selected such that the number of vibrations, or frequency, of the wall surface was 53.3 Hz.

Inventive Example 1-4

The same apparatus as in Inventive Example 1-1 was used to manufacture a longitudinally stretched nonwoven fabric under the same conditions as in Example 1-1 except that the rotational direction of the air stream vibrating mechanism was opposite direction to Inventive Example 1-1.

Inventive Example 1-5

The same apparatus as shown in FIG. 9 was used to manufacture a longitudinally stretched nonwoven fabric under the same conditions as in Inventive Example 1-1 except that the number of vibrations, or frequency, of the wall surface was 25.0 Hz.

Comparative Example 1-1:

In Inventive Example 1-1, the air stream vibrating mechanism was not used, and the filaments were collected on the conveyor. The collected filaments were longitudinally stretched into a longitudinally stretched nonwoven fabric. In this example, since the filaments could not be stretched 5.5 times, the nonwoven fabric was evaluated for its properties at a maximum stretching magnification achieved.

Comparative Example 1-2

In Inventive Example 1-1, when the filaments were collected on the conveyor, the filaments were not cooled by the spray nozzle, and the collected filaments were longitudinally stretched into a longitudinally stretched nonwoven fabric. In this example, since the filaments could not be stretched 5.5 times, the nonwoven fabric was evaluated for its properties at a maximum stretching magnification achieved.

Inventive Example 2-1

The same apparatus as shown in FIG. 3 was used to manufacture a longitudinally stretched nonwoven fabric. The spunbond die had spinning nozzles having a nozzle diameter of 0.3 mm, and extruded a molten polyethylene terephthalate resin having an intrinsic viscosity of 0.63 dl/g as a number of filaments at a die temperature of 330° C. The extruded filaments were guided by air from the ejector and drafted into filaments of reduced diameter. The filaments of reduced diameter were vibrated in the longitudinal direction by an air stream vibrating mechanism and aligned in the longitudinal direction, and collected on the conveyor. The air stream vibrating mechanism was of the type shown in FIGS. 4*a* and 4*b*, and rotated such that the number of vibrations, or frequency, of the wall surface was 26.6 Hz. The filaments collected on the conveyor were stretched longitudinally by 5.5 times into a longitudinally stretched nonwoven fabric.

Comparative Example 2-1

In Inventive Example 2-1, the air stream vibrating mechanism was not used, and the filaments were collected on the conveyor. The collected filaments were longitudinally stretched into a longitudinally stretched nonwoven fabric. In this example, since the filaments could not be stretched 5.5 times, the nonwoven fabric was evaluated for its properties at a maximum stretching magnification achieved.

Table 1 shown in follow sets forth the properties of the samples according to the above Inventive and Comparative Examples.

TABLE 1

| | Material resin | Spinning process | Frequency (Hz) | Extent of filament vibration (mm) | Stretching magnification | Breaking strength (mN/tex) | Elongation (%) |
|---|---|---|---|---|---|---|---|
| In. Ex. 1-1 | PET (1) | Improved MB | 20.0 | 320 | 5.5 | 204.9 | 8 |
| In. Ex. 1-2 | " | Improved MB | 11.7 | 180 | 5.5 | 190.7 | 8 |
| In. Ex. 1-3 | " | Improved MB | 53.3 | 130 | 5.5 | 185.4 | 7 |
| In. Ex. 1-4 | " | Improved MB | 25.0 | 400 | 5.5 | 249.0 | 7 |
| Co. Ex. 1-1 | " | Improved MB | — | 65 | 3.0 | 96.2 | 3 |
| Co. Ex. 1-2 | " | Improved MB | 20.0 | 280 | 5.0 | 135.1 | 6 |
| In. Ex. 2-1 | PET (2) | Improved SB | 26.7 | 220 | 4.5 | 278.1 | 17 |
| Co. Ex. 2-1 | " | Improved SB | — | 40 | 2.5 | 160.7 | 9 |

TABLE 1-continued

| | Material resin | Spinning process | Frequency (Hz) | Extent of filament vibration (mm) | Stretching magnification | Breaking strength (mN/tex) | Elongation (%) |
|---|---|---|---|---|---|---|---|
| Co. Ex. 3 | PET | Commercially available SB | — | — | — | 63.6 | 23 |
| Co. Ex. 4 | PP | Commercially available SB | — | — | — | 17.7 | 18 |

Note)
PET (1): Polyethylene terephthalate, $\eta$ = 0.57 dl/g
PET (2): Polyethylene terephthalate, $\eta$ = 0.63 dl/g
PP: Polypropylene, SB: Spunbond, MB: Melt-blow Table 1 also sets forth, for reference, the properties of a spunbond nonwoven fabric (Comparative Example 3) and a melt-blow nonwoven fabric (Comparative Example 4) as commercially available nonwoven fabrics that are longitudinally stretched 5.5 times. The properties indicated represent the result in only the longitudinal direction of a long-fiber filament nonwoven fabric test according to JIS (Japanese Industrial Standard) L1096. According to JIS, the breaking strength is represented as a breaking load per 5 cm. In Table 1, since the sample nonwoven fabrics had different weights, the weights of the nonwoven fabrics were converted into tex (mass per 1000 m of filament), and the breaking strength was indicated as mechanical strength per tex (mN/tex). The extent of filament vibration was determined by sampling the nonwoven fabric prior to being stretched, separating the filaments, and actually measuring the extent of filament vibration. For Comparative Example 3 and Comparative Example 4, however, the extent of filament vibration could not be measured as the filaments were bonded together by embossed bonding.

While preferred embodiments of the present invention have been described using specific terms, such description is for illustrative purposes only, and it is to be understood that changes and variations may be made without departing from the spirit or scope of the following claims.

What is claimed is:

1. A method of manufacturing a longitudinally aligned nonwoven fabric, comprising the steps of:

preparing a group of nozzles for extruding a plurality of filaments, a conveyor for collecting and delivering the filaments extruded from said group of nozzles, and at least one air stream vibrating mechanism comprising a shaft and a wall surface rotating on the shaft for vibrating a high-speed air stream blown to the filaments;

extruding the filaments from said group of nozzles toward said conveyor;

carrying the filaments extruded from said group of nozzles with said high-speed air stream to attenuate the filaments; and periodically changing the direction of said high-speed air stream in the machine direction of said conveyor by rotating the wall surface of said air stream vibrating mechanism, thereby collecting the filaments on said, conveyor to form a longitudinally aligned nonwoven fabric.

2. A method according to claim 1, wherein said wall surface of said air stream vibrating mechanism is disposed in a region where said high-speed air stream flows, at least one of the direction of said wall surface with respect to the direction of said high-speed air stream and the distance of said wall surface from the direction of said high-speed air stream being variable, and said step of periodically changing the direction of said high-speed air stream comprising the step of periodically changing at least one of said direction and said distance of the wall surface of said air stream vibrating mechanism.

3. A method according to claim 2, wherein said step of preparing the air stream vibrating mechanism comprises the step of positioning a pair of air stream vibrating mechanisms symmetrically with respect to the air stream axis of said high-speed air stream, and said step of extruding the filaments comprises the step of extruding said filaments between said pair of air stream vibrating mechanisms.

4. A method according to claim 1, wherein said wall surface of said air stream vibrating mechanism is inclined to the direction of said high-speed air stream, the distance between said wall surface and the air stream axis of said high-speed air stream being variable, and said step of periodically changing the direction of said high-speed air stream comprising the step of periodically changing said distance between said wall surface and the air stream axis of said high-speed air stream.

5. A method according to claim 1, further comprising the step of:

cooling, with a mist, the high-speed air stream which has been supplied at a temperature equal to or higher than the melting point of the material of said filaments.

6. An apparatus for manufacturing a longitudinally aligned nonwoven fabric, comprising:

spinning means for extruding a plurality of filaments from nozzles;

high-speed air stream generating means for generating a high-speed air stream to carry the filaments extruded from said nozzles to attenuate the filaments;

a conveyor for collecting and delivering the filaments attenuated by said high-speed air stream; and at least one air stream vibrating means comprising a shaft and a wall surface rotating on the shaft for periodically changing the direction of said high-speed air stream in the machine direction of said conveyor.

7. An apparatus according to claim 6, wherein said wall surface of said air stream vibrating means is disposed in a region where said high-speed air stream flows, at least one of the direction of said wall surface with respect to the direction of said high-speed air stream and the distance of said wall surface from the direction of said high-speed air stream being variable.

8. An apparatus according to claim 7, wherein said air stream vibrating means comprises a plurality of air stream vibrating means.

9. An apparatus according to claim 8, wherein said plurality of air stream vibrating means comprise two air stream vibrating means positioned symmetrically with respect to the air stream axis of said high-speed air stream.

10. An apparatus according to claim 9, wherein said two air stream vibrating means are arranged to alternately attract the filaments according to the Coanda effect.

11. An apparatus according to claim 7, wherein said air stream axis of said high-speed air stream and said wall surface are spaced from each other by a minimum distance of at most 25 mm.

12. An apparatus for manufacturing a longitudinally aligned nonwoven fabric, comprising:

spinning means for extruding a plurality of filaments from nozzles;

high-speed air stream generating means for generating a high-speed air stream to carry the filaments extruded from said nozzles to attenuate the filaments;

a conveyor for collecting and delivering the filaments attenuated by said high-speed air stream; and at least one air stream vibrating means for periodically changing the direction of said high-speed air stream in the machine direction of said conveyor, wherein said air stream vibrating means has a wall surface disposed in a region where said high-speed air stream flows, at least one of the direction of said wall surface with respect to the direction of said high-speed air stream and the distance of said wall surface from the direction of said high-speed air stream being variable; and said air stream vibrating means comprises a rotatable bar rotatable about a shaft parallel to the transverse direction of a nonwoven fabric to be manufactured, said rotatable bar having a circumferential surface whose distance from said shaft periodically varies in a circumferential direction.

13. An apparatus according to claim 12, wherein said rotatable bar has an elliptic cross section.

14. An apparatus according to claim 12, wherein said rotatable bar comprises a cylindrical body having a pair of projections mounted on a circumferential surface of said cylindrical body in diametrically opposite relation to each other across said shaft, said projections extending along said shaft.

15. An apparatus according to claim 14, wherein said cylindrical body has a plurality of holes for ejecting air which are defined in a portion of said circumferential surface free of said projections.

16. An apparatus according to claim 12, wherein said rotatable bar comprises a regular polygonal prism.

17. An apparatus according to claim 16, wherein the circumferential surface of said regular polygonal prism has curved edges.

18. An apparatus for manufacturing a longitudinally aligned nonwoven fabric, comprising:

spinning means for extruding a plurality of filaments from nozzles;

high-speed air stream generating means for generating a high-speed air stream to carry the filaments extruded from said nozzles to attenuate the filaments;

a conveyor for collecting and delivering the filaments attenuated by said high-speed air stream; and at least one air stream vibrating means for periodically changing the direction of said high-speed air stream in the machine direction of said conveyor, wherein said air stream vibrating means has a wall surface disposed in a region where said high-speed air stream flows, at least one of the direction of said wall surface with respect to the direction of said high-speed air stream and the distance of said wall surface from the direction of said high-speed air stream being variable; and said air stream vibrating means comprises a plate having a principal surface facing said high-speed air stream and swingable about an axis parallel to the transverse direction of a nonwoven fabric to be manufactured.

19. An apparatus according to claim 18, wherein said plate is swingable about a lower end.

20. An apparatus according to claim 18, wherein said plate is swingable about an upper end thereof.

21. An apparatus according to claim 6, wherein said wall surface of said air stream vibrating means is inclined to the direction of said high-speed air stream, the distance between said wall surface and the air stream axis of said high-speed air stream being variable.

22. An apparatus according to claim 6, further comprising:

cooling means for cooling said high-speed air stream or said filaments.

* * * * *